US011842658B2

(12) United States Patent
Flórez Vargas et al.

(10) Patent No.: US 11,842,658 B2
(45) Date of Patent: Dec. 12, 2023

(54) DEVICE FOR POSITIONING ITEMS

(71) Applicant: PRETENSADOS DE CONCRETO DEL ORIENTE—PRETECOR LTDA, Bucaramanga (CO)

(72) Inventors: Julián Guillermo Flórez Vargas, Bucaramanga (CO); Daniel Fernando Montero Meza, Floridablanca (CO); Carlos Emilio Silva Parra, Bucaramanga (CO)

(73) Assignee: Pretensados de Concreto del Oriente—PRETECOR Ltda, Bucaramanga (CO)

( * ) Notice: Subject to any disclaimer, the term of this patent is extended or adjusted under 35 U.S.C. 154(b) by 0 days.

(21) Appl. No.: 17/789,774

(22) PCT Filed: Dec. 22, 2020

(86) PCT No.: PCT/IB2020/062319
§ 371 (c)(1),
(2) Date: Jun. 28, 2022

(87) PCT Pub. No.: WO2021/137096
PCT Pub. Date: Jul. 8, 2021

(65) Prior Publication Data

US 2023/0038692 A1 Feb. 9, 2023

(30) Foreign Application Priority Data

Dec. 30, 2019 (CO) ..... NC2019/0015119

(51) Int. Cl.
*G09F 7/18* (2006.01)
*E04H 12/02* (2006.01)
*E04H 12/20* (2006.01)

(52) U.S. Cl.
CPC ..... *G09F 7/18* (2013.01); *E04H 12/02* (2013.01); *E04H 12/20* (2013.01); *G09F 2007/1821* (2013.01)

(58) Field of Classification Search
CPC ... G09F 2007/1821; G09F 7/18; E04H 12/02; E04H 12/20
See application file for complete search history.

(56) References Cited

U.S. PATENT DOCUMENTS 3,579,885 A 5/1971 Iverson
4,329,801 A 5/1982 Clausen
(Continued)

FOREIGN PATENT DOCUMENTS

CO 2018012392 A1 5/2020
GB 2203882 A 10/1988
KR 101360840 B1 2/2014

*Primary Examiner* — Gary C Hoge
(74) *Attorney, Agent, or Firm* — The Morales Law Firm; Joseph L. Morales, Esq.

(57) ABSTRACT

The present invention corresponds to a device for positioning elements along a support body, comprising a first plate with a groove on its perimeter and a second plate with a groove on its perimeter, the first plate is in contact with the second plate, wherein the groove of the first plate and the groove of the second plate are coincident, and in which the positioning elements are arranged between the grooves of the first plate and the second plate. Additionally, the first plate and second plate have fastening means allowing them to be fastened to the support body.

11 Claims, 5 Drawing Sheets

(56) References Cited

U.S. PATENT DOCUMENTS

| | | | | |
|---|---|---|---|---|
| 8,333,388 | B2 * | 12/2012 | Taft | G03G 15/754 29/895.32 |
| 2004/0168936 | A1 * | 9/2004 | Johnson | G09F 19/00 |
| 2007/0187568 | A1 * | 8/2007 | Titus | G09F 15/0025 248/576 |
| 2014/0255228 | A1 * | 9/2014 | Yaschur | F04B 53/16 417/472 |
| 2014/0259832 | A1 * | 9/2014 | Todd | E04H 12/2238 40/607.03 |
| 2015/0198299 | A1 * | 7/2015 | Ruiz Bonet | F21S 10/00 362/277 |
| 2017/0162086 | A1 | 6/2017 | Bradley | |
| 2019/0327956 | A1 | 10/2019 | Bartel | |
| 2020/0342793 | A1 * | 10/2020 | Patterson | G09F 13/22 |
| 2021/0384669 | A1 * | 12/2021 | Mugan | F21V 23/06 |
| 2022/0406229 | A1 * | 12/2022 | Lee | G09F 19/12 |

* cited by examiner

DEVICE FOR POSITIONING ITEMS

FIELD OF THE INVENTION

The present invention corresponds to devices for fastening and positioning different types of elements, such as lighting devices in different types of buildings, walls, columns or poles for public lighting.

DESCRIPTION OF THE PRIOR ART

Nowadays, with the saturation of urban buildings, the means to display advertisements in public spaces, such as advertisements that include lighting, generally adopt an anchoring and lighting system comprising a lamp, a cable and a transformer. These types of systems are limited to illuminating the streets or highways, thus, wasting the opportunity to display advertising or messages to people, wherein said messages that can be displayed could be both decorative and informative. At present, billboards or posters are usually hung on the facades or on some poles or columns. Sometimes, these billboards or existing posters cannot be clearly seen at night because they are either arranged in an area that cannot be easily observed by people, because they do not have any type of lighting, or sometimes the information desired to be displayed is not shown in its entirety, because the means to fasten it obstruct the view. Additionally, traditional posters and advertisements may need a large space to present the information, thus saturating the environment.

However, with the development of new technologies to provide different visual notices, LED technology has been incorporated to advertising. However, the provision of such visual advertisements and the integration of advertising with LED technology, generates problems at the time of its arrangement in the required spaces, due to environmental conditions, such as rain or high-speed winds that may damage the information. Therefore, in the prior art, publications related to devices for placing advertisements on lighting poles with intelligent messages are identified, e.g., patent document number NC2018/0012392.

Said document NC2018/0012392 corresponds to an intelligent pole, which comprises a structural body with an internal cavity, said structural body is made of a translucent material, a support body disposed in the internal cavity of the structural body, wherein the support body extends longitudinally along the structural body. Said smart pole comprises a light-emitting device located between the structural body and a support body, wherein a light-emitting device is supported on the support body, and a control unit connected to the light-emitting device.

Said document also discloses a support body that has at least one positioning accessory, which allows fastening different elements. Said accessory for positioning elements is a plate with at least one perforation, to maintain a light-emitting device such as a LED strip in a desired position.

Therefore, although the prior art discloses an accessory for arranging elements with LED technology, said document does not teach how to arrange elements without them detaching from it. Said document also does not teach how to arrange elements, such as LED technology, in such a way that the visual information it presents can be displayed in different ways, without said positioning accessories blocking the information it wishes to display, maintaining a correct fastening thereof.

BRIEF DESCRIPTION OF THE INVENTION

This invention corresponds to a device for positioning elements, in order to arrange elements such as advertisements or lighting in private or public places, in such a way that the environmental conditions or the constant interaction with users do not knock down what is to be positioned in the device, and that additionally, when an element is positioned in the element positioning device, said device does not visually block the element to be positioned, be it a light-emitting device or another element.

Therefore, the present invention corresponds to a device for positioning elements along a support body, which in one embodiment comprises a first plate with a groove on its perimeter and a second plate with a groove on its perimeter, in which the first plate is in contact with the second plate. The grooves of both plates are coincident, in such a way that the elements to be positioned are arranged between the grooves of the first plate and the second plate. Additionally, the first plate and second plate have fastening means, allowing them to be fastened to the support body.

Said device for positioning elements allows for positioning light-emitting devices, e.g., LED strips on the groove, which allows the device to position elements on columns or poles for street lighting and, thus, generate different visual advertisements.

DETAILED DESCRIPTION OF THE INVENTION

The present invention corresponds to a device for positioning elements, in order to arrange elements such as advertisements or lighting in private or public places, in such a way that the environmental conditions or the constant interaction with users do not knock down what is to be positioned in the device, and that additionally, when an element is positioned in the element positioning device, said device does not visually block the element to be positioned, be it a light-emitting device or another element.

Therefore, the present invention corresponds to a device for positioning elements along a support body, comprising a first plate (1*a*) with a groove (2) on its perimeter, and a second plate (1*b*) with a groove (2) on its perimeter, the first plate (1*a*) is in contact with the second plate (1*b*). The groove (2) of the first plate (1*a*) and the groove (2) of the second plate (1*b*) coincide, which allows an element to be arranged in the grooves (2) of both plates. Additionally, the first plate (1*a*) and second plate (1*b*) have fastening means allowing said plates to be fastened to the support body.

Figure 1:
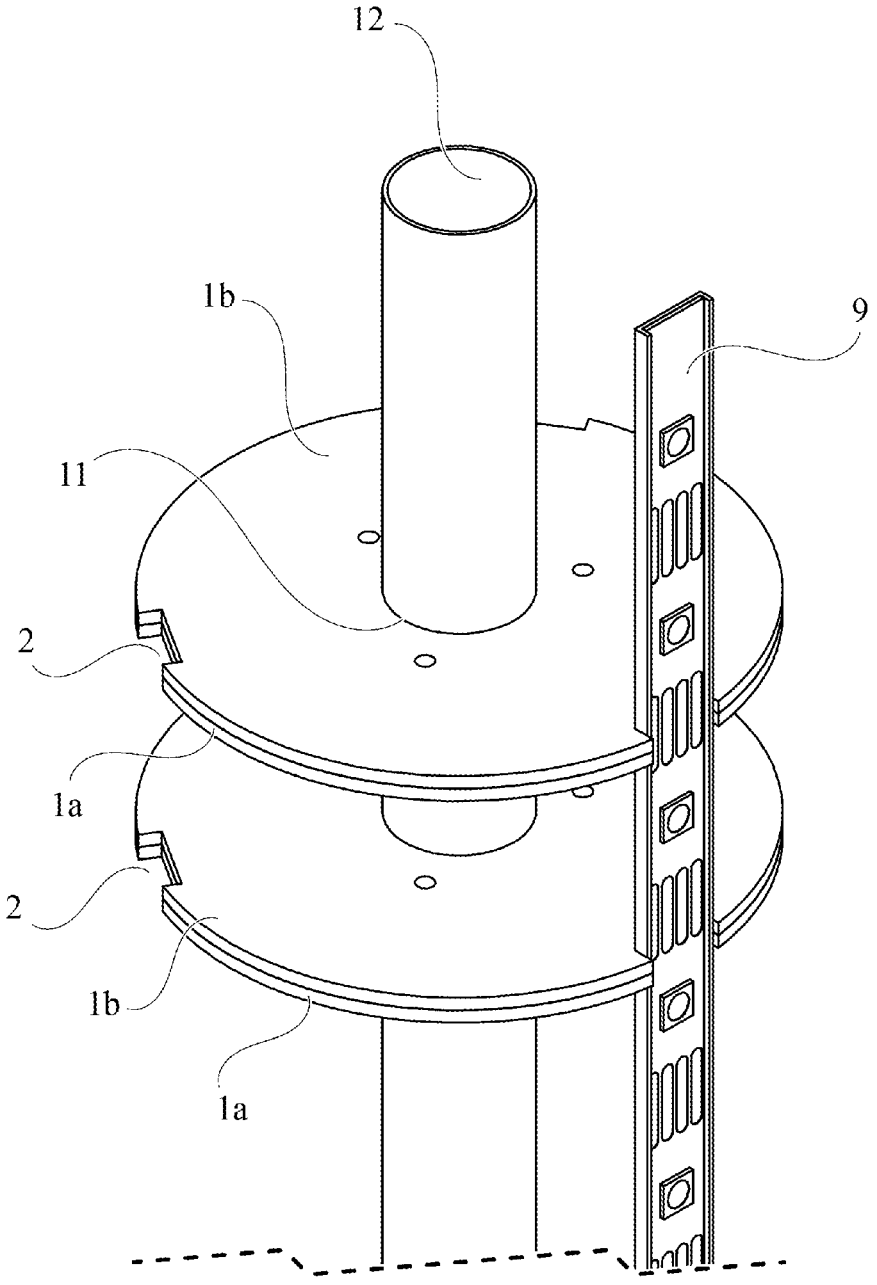
FIG. 1 illustrates an embodiment of the present invention, in which two devices are housed to position elements with a circular shape fastening a LED strip along a support body.

Preferably, and referring to FIG. 1, the shape of the groove (2) has an incorporated shape and a length equal to, smaller or larger with certain tolerances, than that of the element to be arranged there, which allows it to remain coupled there by means of the adjustment between said groove (2) and said element. Additionally, the fact that an element is positioned in the grooves (2) of the first plate (1*a*) and the second plate (1*b*) is that having two plates together increases the contact area between the first plate (1*a*) and the second plate (1*b*), with the element to be arranged between said grooves.

The device for positioning elements in the present invention can contain a plurality of plates, arranged with each other to increase the cross-sectional area of the device for positioning elements and, thus, increase the contact area between the plates and the element to be fastened, which allows for increased grip of the device according to the number of plates.

The groove (2) of this invention can have any shape that will vary depending on the application or element that is going to be housed inside said groove. In this way, if the element to be placed between the groove has a circular shape, then the groove should have a circular shape, so there is a coincidence between the inner surface of the groove and the external shape of the element to be housed therein. Notwithstanding the foregoing, it should be understood that the shape of the groove (2) in the present invention can be selected from the group consisting of squares, triangles, circles, rectangles, pentagons, trapezoids, ellipses, rhombuses, hexagon, heptagon, octagon, decagon, equivalent shapes known to a person of ordinary skill in the art or a combination thereof.

Additionally, the shape of both the first plate (1*a*) and the second plate (1*b*) is selected from the group consisting of: circles, squares, triangles, rectangles, pentagons, trapezoids, ellipses, rhombuses, hexagon, heptagon, octagon, decagon, star, rhombus, regular polygons and any other geometric figure known to a person moderately versed in the matter or combinations thereof.

The shape of the first plate (1*a*) and the second plate (1*b*) allows you to change the number of grooves (2) you have, e.g., when the plates have a triangular shape, and each side has a single groove (2), said device would have only three grooves (2) to position elements. On the other hand, if the plates are hexagon-shaped, and the grooves (2) are interspersed, said device for positioning elements would only have three grooves (2). However, when the shape of the plates corresponds to a regular polygon, such as a square, each of its sides can have more than one groove (2). Additionally, the shape of the plates also allows the device to position elements to adapt to where it is going to be installed.

The plates (1*a*) and (1*b*) of the present invention can be formed by two or more plates joined together in a coplanar manner by means of fastening mechanisms (e.g., riveting, welding, interference fitting, pressure fixing, thermal fixing, staples, and joining mechanisms known to those ordinarily skilled in the art). Interference fits are preferably used as they allow easy coupling and uncoupling. For example, the first plate (1*a*) can be a circular plate, wherein said circular plate is formed by two plates, each of the plates in the shape of a semicircle joined together.

On the other hand, the material of the first plate (1*a*) and the second plate (1*b*) can be made of different materials, in order to provide such rigidity to allow the elements to be supported and positioned within the grooves (2) without deformation of these plates. Moreover, the plates can be made of a translucent material, in such a manner that it does not affect the passage of light. In this way, the plates could be formed by plastic materials (thermo-plastic, thermo-stable), polymer chain composite materials, fibers (natural, synthetic), crystals, ceramics, metallic materials, transparent materials, translucent materials and/or opaque materials, equivalent materials known to a person of ordinary skill in the art, or a combination of the foregoing. In preferred embodiments, the material is transparent so the accessory does not affect the visual signal of the element fastened in the groove (2), when the fastened element is a light-emitting device (9) which shows a visual signal.

The material of each plate of the element positioning device can be of different materials, which allows the properties of the element positioning device to be changed as desired. For example, when the device for positioning elements has two plates, one of the plates can be made of a translucent material, while the other can be made of a reflective material. On the other hand, when the device for positioning elements has two or more plates, one of the plates may be a metal plate, but the other plate(s), depending on the number, can be made of a less dense material. This allows the metallic silver to provide rigidity to the device to position elements, while the other plates are made of another material to reduce its weight.

Referring to FIG. 1, when the first plate (1*a*) and the second plate (1*b*) are regular polygons, they can have at least one groove (2) in each of their edges, or arranged intercalated between said edges. When the first plate (1*a*) and the second plate (1*b*) are circumferentially shaped, said plates may have a plurality of grooves (2) around their entire perimeter.

On the other hand, a support body (12) can be connected to the device for positioning elements. The support body (12) is a bar, a pipe or a column, which is inserted into the fastening means when it contains a perforation (11), which allows both the first plate (1*a*) and the second plate (1*b*) in a desired position along said support body (12), i.e., the support body (12) is configured to place the first plate (1*a*) and second plate (1*b*) in a certain position.

Figure 5:
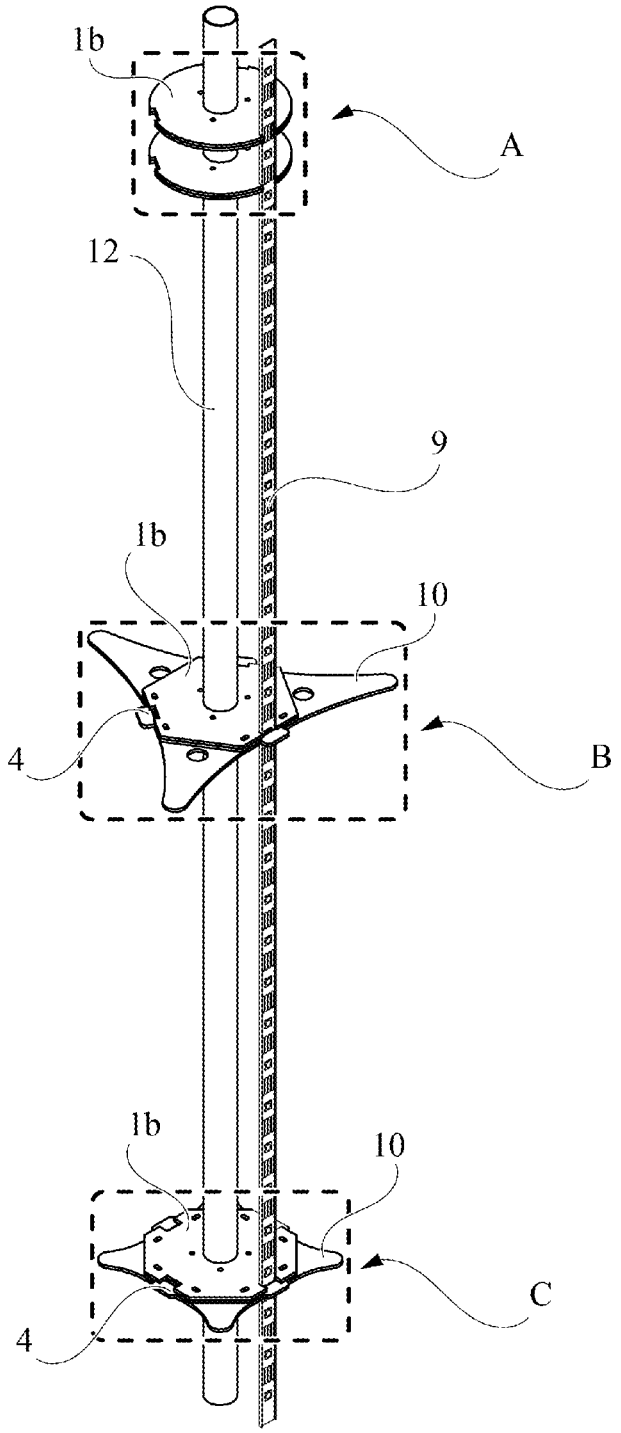
FIG. 5 illustrates different embodiments of the device for positioning elements in the present invention, arranged along a bar, which are fastening a LED strip.

Referring to FIG. 5, a plurality of devices can be arranged on the support body (12) to position elements along said support body (12), wherein the shapes of plates of each device for positioning elements can be different, which allows having different configurations of devices for positioning elements along the support body (12).

On the other hand, the first plate (1*a*) and the second plate (1*b*) include fastening means that allow said plates to be fastened to the support body. Said fastening means are optionally selected from the group formed by screws, bolts, nuts, rivets, studs, pins, wedges, clamps, equivalent elements known to a person of ordinary skill in the art, or a combination thereof.

Figure 2:
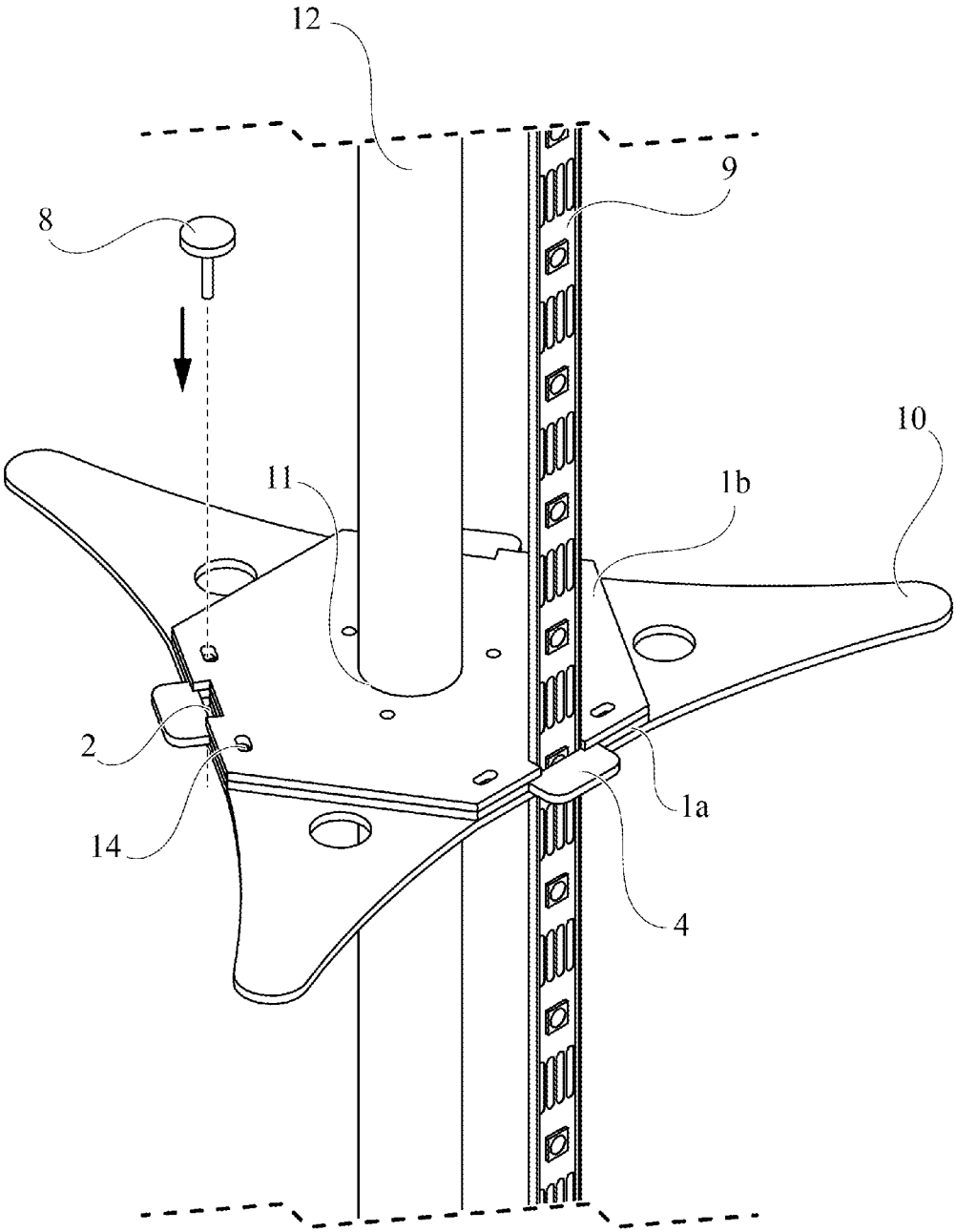
FIG. 2 illustrates an embodiment of the present invention, in which the device for positioning elements is formed by three plates having a three-sided triangular or deltoid external shape, fastening a LED strip.
Figure 3:
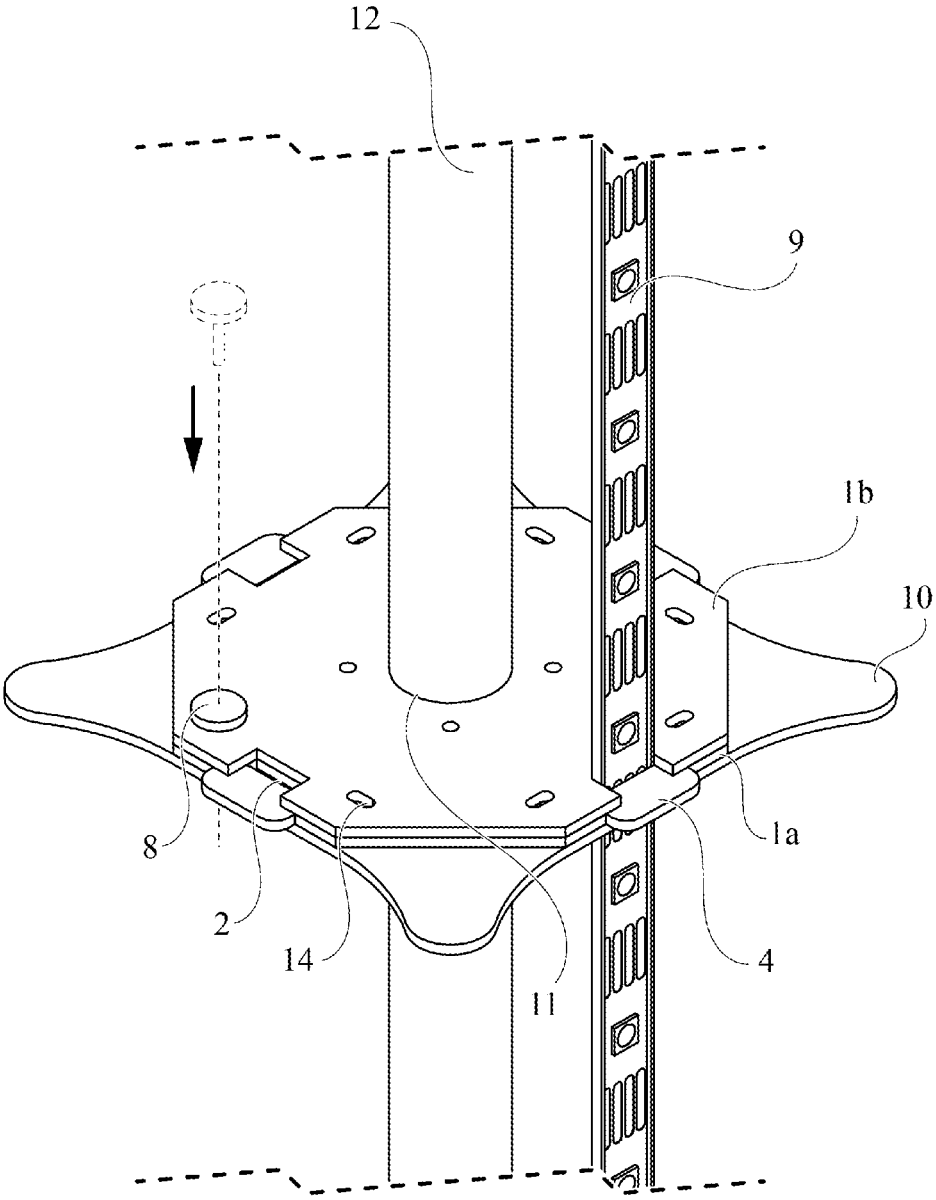
FIG. 3 illustrates an embodiment of the present invention, in which the device for positioning elements is formed by three plates with an external shape consisting of four sides, fastening a LED strip.

In one embodiment of the invention, and referring to FIG. 1, FIG. 2 and FIG. 3, the fastening means of any plate correspond to a perforation (11), allowing the support body (12) to be inserted into said perforation (11) and arranging the device to position elements in a certain position. The perforation (11) can be positioned anywhere on the surfaces of the first plate (1*a*) and the second plate (1*b*), e.g., if the first plate (1*a*) and the second plate (1*b*) have a circular shape or rectangular, the perforation (11) can be at the centroid or at one of the ends.

Referring again to FIG. 1, FIG. 2, FIG. 3 and to FIG. 5, when the fastening means is a perforation (11), said support body (12) is inserted into said perforation (11) and is joined to the first plate (1*a*) and to the second plate (1*b*) by means of pressure, or fastening elements such as screws, bolts, nuts, rivets, studs, pins, wedges, clamps, welding, equivalent fasteners known to a person of ordinary skill in the art, or a combination thereof.

Although the support body (12) can be a bar or a tube, said support body (12) is optionally a non-straight bar, e.g., said support body (12) can be a bar with an arc, wavy, curved, zigzag, broken shape, among others, in order to generate different shapes, which allows different devices to position elements. Additionally, when the support body (12) is a tube, wiring can be inserted inside it according to requirements, or when the light-emitting device (9) requires it.

Referring to FIG. 1, there are two devices to position elements along a support body (12) which is a bar. Each of the two devices for positioning elements is formed by a first plate (1*a*) and a second plate (1*b*), wherein the first plate (1*a*) and the second plate (1*b*) are circular plates, one arranged on top of the other, wherein both have a groove (2) with a rectangular shape on their perimeter. The devices to position elements are separated from each other on the support body (12), and a light-emitting device (9) corresponding to a LED strip is arranged in the grooves (2) of said devices to position elements. The groove of FIG. 1 has a rectangular shape, and so does the light-emitting device (9), which allows them to be coupled together.

Referring again to FIG. 1, each of the first plate (1*a*) and second plate (1*b*) of each device for positioning elements, have a fastening means corresponding to a circular perforation (11) at its centroid, wherein a support body (12) corresponding to a straight vertical tube is located in said perforation (11).

Additionally, the support body (12) can have the shape of a bar that is not straight throughout its length, which allows different devices to position elements and, in turn, to have different light-emitting devices (9) in different positions. This allows generating different types of visual signs with different shapes, depending on the shape of the support body (12) and the arrangement of the devices to position elements on it.

In one embodiment of the invention, when the fastening means is a perforation (11), in said contour of the perforation (11) of the first plate (1*a*) or in the contour of the perforation (11) of the second plate (1*b*) a support element (13) is provided. Said support element (13) has a shape integral with the contour of the perforation (11) of any of the plates, wherein said support element (13) has a perforation (11) through which the support body (12) is inserted. Additionally, said support element (13) can be located only in the perforation (11) of the first plate (1*a*), in the perforation (11) of the second plate (1*b*), or in both perforations (11). The device for positioning elements can also have two support elements (13) located on each one of the contours of the perforation (11) of each plate.

Said support element (13) is an element that generates pressure and friction in the support body (12), which allows neither the first plate (1*a*) nor the second plate (1*b*) to move on the support body (12) without an external force being exerted. For example, the support element (13) can be a ring, an O-ring or a gasket, which generates pressure in the support body (12), thus allowing the device to position elements in a support body (12) preventing it from moving through said support body (12) and without requiring other additional fastening elements, such as rivets or screws.

The material of said support element (13) is selected from the group consisting of: natural rubber, polyisoprene, polybutadiene, styrene-butadiene rubber, butyl rubber, nitrile rubber, equivalent elastomeric materials known to a person of ordinary skill in the art, or a combination thereof. The fact that said support element (13) is made of an elastomeric material allows greater friction and pressure to be generated with the support body (12), allowing the first plate (1*a*) and the second plate (1*b*) to be secured with said support body (12).

Figures 4, 4A, 4B:
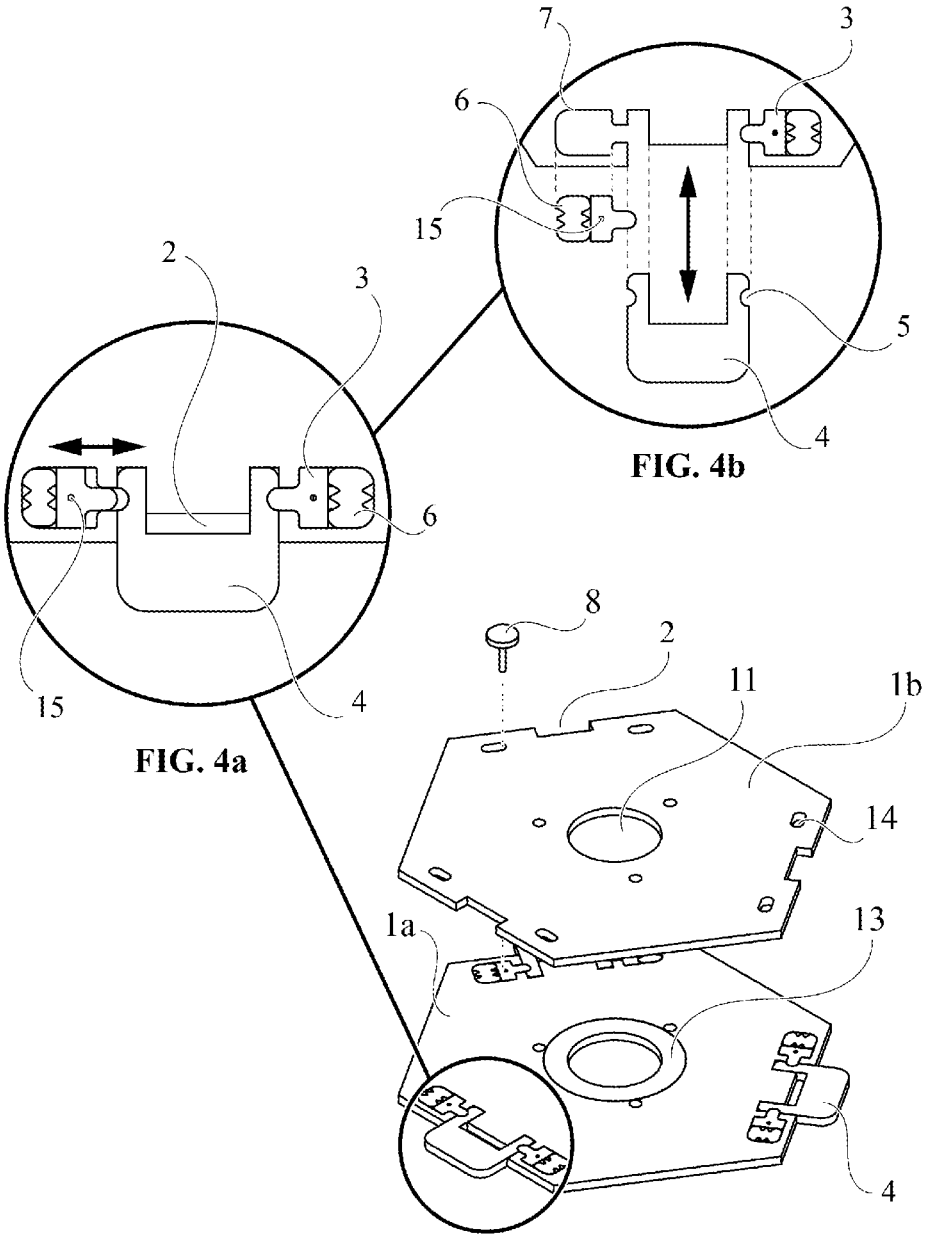
FIG. 4 illustrates an exploded view of an embodiment in the present invention, in which the element positioning device is formed by two plates.
FIGS. 4A and FIG. 4B show details of a locking pin.

On the other hand, and referring to FIG. 2, FIG. 3, and FIG. 4, the device for positioning elements can have a fastener (4). Said fastener (4) is located in the groove (2) of any plate, wherein an enclosure is formed between the groove (2) of any of plates (1*a*) and (1*b*) and the fastener (4). Said enclosure allows different elements to be arranged or secured there, between the first plate (1*a*) and the fastener (4). The fastener (4) allows securing the elements to be arranged in the groove (2), in such a way that if you want to remove the element arranged in the groove (2), you must first remove the fastener (4).

In one embodiment of the invention, a light-emitting device (9) is arranged in the enclosure between the groove (2) of any of plates (1*a*), (1*b*) and the fastener (4), wherein said light-emitting device (9) can be a LED strip. Preferably, the fastener (4) has a shape integral with the groove (2), which allows them to fit together. For the understanding of this invention, it will be understood that two elements have an incorporated shape, that two elements have a tongue-and-groove-type connection, which allows them to fit together.

Referring to FIG. 4, preferably, the fastener (4) is arch-shaped, or hook-shaped or staple-shaped, i.e., formed by three parts, a first oblong part with two longitudinal ends, a second oblong part located at one end of the first part, and a third oblong part located at the other end of the first part.

Referring to FIG. 2, the device for positioning elements comprises a first plate (1*a*) and a second plate (1*b*) arranged above the first plate (1*a*). Both plates had a hexagonal shape, wherein they had a groove (2) on three of their sides. In the centroid of the first plate (1*a*) and the second plate (1*b*) they have a circular perforation (11) in which a support body (12) is inserted. In said FIG. 2 the device for positioning elements also has a fastener (4) arranged in a groove (2), and in the space between said groove (2) and the fastener (4), a light-emitting device (9) is arranged corresponding to a LED strip.

On the other hand, and referring to FIG. 4, any of the plates can include a guide (7) where a locking pin (3) is positioned, which has a first end and a second end. The first end of the locking pin (3) is adjacent to the groove (2), and said locking pin (3) can be moved along said guide (7). When the first plate (1*a*) has a locking pin (3), the fastener (4) has a notch (5), wherein the first end of the locking pin (3) fits in the notch (5) of the fastener (4). For the understanding of this invention, a notch (5) will be understood as a concavity or hole that is already there or is made on something to fit another element.

It should be understood in the present invention that the guide (7) is a canal, a concavity, or a covered and elongated tunnel-type element, wherein the locking pin (3) is arranged. When the first end of the locking pin (3) fits in the notch (5) of the fastener (4), the locking pin (3) prevents the fastener (4) from moving in the groove (2). Preferably, the shape of the notch (5) and the first end of the locking pin (3) have an incorporated shape, which allows them to be coupled without the need for any pressure.

In one embodiment of the invention, and referring to FIG. 4, the guide (7) is a grooved guide (7). For the understanding of this invention, a grooved guide (7) will be understood as a narrow and oblong perforation to guide a movable part in said guide. When the guide (7) is a grooved guide (7), the locking pin (3) is arranged there, which allows it to move on said guide (7).

The first plate (1*a*) can have said grooved guide (7) while the second plate (1*b*) does not or vice versa, which allows the locking pin (3) to rest on said second plate (1*b*) while the locking pin (3) slides on the grooved guide (7), when the second plate (1*b*) is located below the first plate (1*a*).

Additionally, both the first plate (1*a*) and the second plate (1*b*) can have a grooved guide (7). When the first plate (1*a*) and the second plate (1*b*) have a grooved guide (7), said guide (7) and the groove (2) coincide.

Additionally, and referring again to FIG. 4, the locking pin (3) can be connected with a displacement element (8), wherein the displacement element (8) is configured to displace the locking pin (3) along the guide (7). In one embodiment of the invention, the locking pin (3) has a hole (15) and the displacement element (8) is an element that is inserted into said hole (15) of the locking pin (3). This allows the displacement element (8) to be inserted into the hole (15) of the locking pin (3) and move it along the guide (7).

Said scrolling element (8) can be a thumb stack, cables, needles, pins, or equivalent elements to be inserted into the hole (15) of the locking pin (3) allowing a user to move said locking pin (3) on the guide (7).

In one embodiment of the invention, and referring to FIG. 4, the second end of the locking pin (3) is connected to a pressure element (6), in such a way that it continuously exerts a force on the locking pin (3) along the guide (7). Said pressure element (6) is an element capable of storing energy when an external force acts on it, and is capable of releasing said energy without undergoing permanent deformation when the forces or tension to which it is subjected cease. For example, when an external force acts on the locking pin (3), moving the first end away from the groove (2), the pressure element (6) stores energy allowing that, when said external force stops acting on the locking pin (3), the first end of the locking pin (3) moves to the groove (2) due to the action exerted by the pressure element (6) when the energy is released.

In the same way, when an external force acts on the locking pin (3), or on the displacement element (8) when it is connected with the locking pin (3) moving the first end away from the groove (2), the element (6) stores energy allowing that, when said external force stops acting on the locking pin (3), the first end of the locking pin (3) moves to the groove (2) due to the action exerted by the element of pressure (6) when the energy is released.

Said pressure element (6) is selected from the group formed by springs, natural rubber, polyisoprene, polybutadiene, styrene-butadiene rubber, butyl rubber, nitrile rubber, equivalent elements known to a person of moderate skill in the art or a combination thereof. For example, when the pressure element (6) is an elastic rubber, and a force is exerted on the locking pin (3) in such a way that it moves in the opposite direction to the groove (2), the pressure element (6) is arranged in such a way that it contracts. And, when said force stops acting on the locking pin (3), the first end of the locking pin (3) moves towards the groove (2) due to the elongation of said elastic band, and subsequently towards the notch (5) of the fastener (4).

In an embodiment of the invention, the pressure element (6) is a spring. When an external force acts on the locking pin (3), or on the displacement element (8) when it is connected with the locking pin (3), the pressure element (6) contracts, moving the locking pin (3) on the guide (7). When said force ceases to act on the locking pin (3) or the displacement element (8), the first end of the locking pin (3) moves to the groove (2) due to the fact that said spring, i.e., the element (6), elongates pushing the locking pin (3) on the guide.

In one embodiment of the invention, and referring to FIG. 4, the device for positioning elements comprises a first plate (1*a*) and a second plate (1*b*) arranged above the first plate (1*a*). Both plates have a hexagonal shape, whose three sides have a matching groove (2) with a rectangular shape, wherein a circular perforation (11) is arranged in the centroid of the first plate (1*a*) and the second plate (1*b*), wherein a support element (13) corresponding to a ring is arranged on its contour.

Referring to the detail FIG. 4*a*, and FIG. 4*b* of FIG. 4, the first plate (1*a*) has a grooved guide (7), wherein the guide (7) is connected to the groove (2). Inside said guide (7) a locking pin (3) with a first end and a second end is located, wherein the first end is located in the part of the guide (7) that connects with the groove (2). Inside the grooved guide (7), there is a pressure element (6) connected to the second end of the locking pin (3), wherein the locking pin (3) has a lesser length than the length of the guide (7), which allows said locking pin (3) to move along the grooved guide (7).

Referring to FIG. 4, the locking pin (3) has a hole (15) through which a displacement element (8) is connected, which allows the locking pin (3) to be moved along the grooved guide (7). Additionally, the second plate (1*b*) has an additional perforation above the grooved guide (7), which allows the displacement element (8) to be connected to the locking pin (3), and to be able to move said locking pin (3) along the guide (7).

The device for positioning elements of FIG. 4 has a non-circular arc-shaped fastener (4) which has a notch (5). Said notch (5) is integral with the second end of the locking pin (3) so as to lock the fastener (4) in the groove (2). FIG. 4 further illustrates that the fastener (4) can be connected to the groove (2) of the first plate (1*a*), bringing it orthogonally closer to said plate. However, the fastener (4) and the groove (2) can also be connected at an angle.

In one embodiment of the invention, the support body (12) is located within a structural body. Said structural body can be an oblong element with a cavity with an internal surface, a base and an end opposite to the base, wherein, said base is preferably embedded in the floor or a surface. Said base can also be coupled to a support on the base (e.g., a flange), which is fastened to the floor by means of fastening elements, such as screws, rivets or bolts. On the other hand, the extreme upper end may correspond to an open end, which is sealed by a cap.

The structural body allows to protect the device to position elements, preventing environmental conditions such as temperature, wind, rain, among others, from making direct contact with it and with the elements it is fastening in the groove (2), e.g., a light-emitting device (9).

The support body (12) is inside the structural body, wherein the support body (12) can extend longitudinally along the structural body. The support body (12) can have the same length as the structural body, but it can also be shorter compared to it. The shapes of the support body (12) can be selected from the group consisting of a frustoconical shape, cylinders, pyramidal shape, orthohedral shape, canals with a polygonal cross-section (e.g., square, triangular, pentagonal, hexagonal, rhomboid), known equivalent shapes by a person moderately versed in the matter or a combination thereof. The shape of the support body (12) can be the same shape as the structural body, e.g., if the structural body is in the shape of an arch, the support body (12) would also be in the shape of an arch. Moreover, optionally the support body (12) is concentric within the structural body.

Preferably, the structural body is made of a translucent material, which allows light to be displayed on its external surface, when the device for positioning elements fastens a light-emitting device (9) in the groove (2). The translucent material of the structural body can be selected from the group consisting of fiberglass reinforced polyester (FRP), polymethylmetracylate (PMMA), polyvinyl chloride (PVC); chlorinated polyvinyl chloride (CPVC); polyethylene terephthalate (PET), polyamides (PA) (e.g., PA12, PA6, PA66); polychlorotrifluoroethylene (PCTFE); polyvinylidene fluoride (PVDF); ethylene polytetrafluoride (PTFE); ethylene-chlorotrifluoroethylene (ECTFE); plastics (polyester, vinyl ester, epoxy, vinyl resins) reinforced with fibers (e.g., glass, aramid, polyester) and combinations thereof. In one embodiment of the invention, the translucent material of the structural body is fiberglass reinforced polyester (FRP).

In an embodiment of the invention. the structural body can be formed by at least two parts, which facilitates this maintenance, and also facilitates the installation of the device for positioning elements. When the structural body is formed by two parts, said parts can be longitudinal and/or cross sections of the structural body.

Additionally, when the support body (12) is located inside the structural body, different types of devices can be arranged on said support body (12) to position elements, wherein the shapes of plates in each of said devices can be different. The foregoing allows different devices to be arranged to position elements in such a way that they can be arranged along the structural body, when the structural body has a shape wherein the base has a larger area compared to the end opposite to the base.

In one embodiment of the invention, a positioning plate (10) is provided on the surface of any of the plates (1*a*), (1*b*). Said positioning plate (10) has the largest surface, compared to the first plate (1*a*) or the second plate (1*b*), and allows to fasten the device to position elements inside the structural body, when the device to position elements is located therein. This is because the contour of the positioning plate (10) is arranged on the internal surface of the cavity in the structural body.

Said positioning plate (10) also has a fastening means, such as a perforation (11), wherein the support body (12) is connected. Additionally, on the contour of the perforation (11) of the positioning plate (10), a support element (13) with a perforation can also be located, in such a way that the support body (12) is connected to it.

Preferably, the locating plate (10) allows the groove (2) to be spaced a specific length from the internal surface of the structural body cavity. The foregoing allows the light to be projected with the desired refractive index on the external surface of the structural body, when a light-emitting device (9) is arranged in the groove (2), e.g., a LED strip, and the material of the structural body is a translucent material.

Referring to FIG. 2, the device for positioning elements comprises a first plate (1*a*) and a second plate (1*b*) arranged above the first plate (1*a*). Both plates have a hexagonal shape, wherein they have a matching groove (2) on three of their sides. On the other surface of the first plate (1*a*), a positioning plate (10) is also connected, which has a triangular shape whose vertices are arc-shaped. Said positioning plate (10) has three grooves (2), one on each of its sides, where said grooves (2) coincide with the grooves (2) of the first plate (1*a*) and the second plate (1*b*), wherein there is a perforation (11) in the centroid of the first plate (1*a*), the second plate (1*b*) and the positioning plate (10), which is circular and wherein the support body (12) is inserted.

The fact that the vertices of the positioning plate (10) of FIG. 2 are arch-shaped, allows them to be arranged on the internal surface of the cavity in the structural body, without damaging said internal surface or without breaking them. In said FIG. 2, the positioning plate (10) has its sides in the shape of an arc, which allows the grooves (2) to be spaced from the internal surface of the cavity of the structural body, when the device for positioning elements is arranged inside a structural body.

Referring to FIG. 3, the device for positioning elements comprises a first plate (1*a*) and a second plate (1*b*) arranged above the first plate (1*a*). Both plates have an octagonal shape, wherein they have a groove (2) on four of their sides. Below the first plate (1*a*) a positioning plate (10) is connected, which has four sides whose vertices are arc-shaped, and wherein the four sides of said plate are curved. In the centroid of the first plate (1*a*), the second plate (1*b*) and the positioning plate (10) there is a circular perforation (11) where a support body (12) is inserted. Said positioning plate (10) has four grooves (2), one on each of its sides, where said grooves (2) coincide with the grooves (2) of the first plate (1*a*) and the second plate (1*b*).

In one embodiment of the invention, and referring to FIG. 5, on a support body (12) corresponding to a vertical bar, three different types of devices are arranged to position elements, a first device (A), a second device (B) and a third device (C), along of said support body (12). The first device to position elements (A), corresponds to the device to position elements of FIG. 1, which comprises a first plate (1*a*) and a second plate (1*b*), wherein the first plate (1*a*) and the second plate (1*b*) are circular plates, one arranged on top of the other, wherein both have a groove (2) coinciding with a rectangular shape on their perimeter.

The second device for positioning elements (B) corresponds to the device in FIG. 2, it comprises a first plate (1*a*) and a second plate (1*b*) arranged above the first plate (1*a*) and a positioning plate (10) arranged on one of the surfaces of the first plate (1*a*). Both the first plate (1*a*) and the second plate (1*b*) are plates with a hexagonal shape, wherein they have a groove (2) on three of their sides. In the centroid of the first plate (1*a*) and the second plate (1*b*) there is a circular perforation (11) in which a support body (12) is inserted. In said FIG. 2 and FIG. 5, the device for positioning elements also had a fastener (4) arranged in a groove (2), wherein a light-emitting device was arranged (9) corresponding to a LED strip, in the space between said groove (2) and the fastener (4).

On the other hand, the second device for positioning elements (C) corresponds to the device in FIG. 3, comprising a first plate (1*a*) and a second plate (1*b*) arranged above the first plate (1*a*) and a positioning plate (10) arranged on one of the surfaces of the first plate (1*a*). Both the first plate (1*a*) and the second plate (1*b*) are plates with an octagonal shape, wherein they have a groove (2) on four of their sides. In the centroid of the first plate (1*a*), the second plate (1*b*) and the positioning plate (10) there is a circular perforation (11) wherein the support body (12) is inserted. In said FIG. 3 and FIG. 5, the device for positioning elements also has a fastener (4) arranged in a groove (2), wherein a light-emitting device was arranged (9) corresponding to a LED strip, in the space between said groove (2) and the fastener (4).

Referring to FIG. 5, said LED strip is fastened at the same time by the grooves (2) of the first device for positioning elements (A), second device for positioning elements (B), and of the third device for positioning elements (C).

This invention will be presented in detail through the following examples, which are provided for illustrative purposes only and not for the purpose of limiting its scope.

Example 1

Referring to FIG. 2, the device for positioning elements comprises a first plate (1*a*) with three grooves (2) and a second plate (1*b*) with three grooves (2). The second plate (1*b*) arranged above the first plate (1*a*) wherein the grooves were coincident. Both plates had a hexagonal shape, wherein they had a groove (2) on three of their sides. Below the first plate (1*a*) a positioning plate (10) was connected, which had a triangular shape whose vertices were circular. In the centroid of the first plate (1*a*), the second plate (1*b*) and the positioning plate (10) there was a fastening means corresponding to a circular perforation (11) wherein a support body (12) was inserted corresponding to a circular profile bar.

In said FIG. 2, the device for positioning elements had a fastener (4) arranged in a groove (2), and in the area between said groove (2) and the fastener (4), a light-emitting device (9) was arranged, corresponding to a LED strip.

Example 2

Referring to FIG. 3, the device for positioning elements comprises a first plate (1*a*) and a second plate (1*b*) arranged above the first plate (1*a*). Both plates had an octagonal shape, wherein they had a groove (2) on four of their sides. Below the first plate (1*a*) a positioning plate (10) was connected, which had four sides whose vertices were circular. In the centroid of the first plate (1*a*), the second plate (1*b*) and the positioning plate (10) there was a fastening means which was a circular perforation (11) wherein a support body (12) was inserted. Said support body (12) corresponded to a hollow bar with a circular profile.

The device for positioning elements of FIG. 3 had a fastener (4) arranged in a groove (2), and in the area between said groove (2) and the fastener (4), a light-emitting device (9) corresponding to a LED strip was arranged. In said EXAMPLE 2, to arrange the LED strip, the procedure is as follows: if the fastener (4) is located in the grooves (2), said fastener (4) is removed; subsequently, said strip is arranged in the grooves (2) of the plates, then, the fastener (4) is arranged in the groove (2), which allows the light-emitting device (9) corresponding to the strip to LEDs to be fastened between the fastener (4) and the groove (2).

Additionally, in the contour of the perforation (11) of the first plate (1*a*) a support element (13) was arranged corresponding to a circular rubber ring, wherein the support body (12) was inserted.

Example 3

Referring to FIG. 4, the device for positioning elements of EXAMPLE 2 is illustrated. Said device for positioning elements consisted of a first plate (1*a*) and a second plate (1*b*) arranged above the first plate (1*a*). Both plates had a hexagonal shape, wherein they had a groove (2) on three of their sides. Below the first plate (1*a*) a positioning plate (10) was connected, which had a triangular shape whose vertices were circular. In the centroid of the first plate (1*a*), the second plate (1*b*) and the positioning plate (10) there was a fastening means corresponding to a circular perforation (11) wherein a support body (12) was inserted. The support body (12) was a bar with a circular profile.

Said device for positioning elements had a fastener (4) arranged in a groove (2), and in the area between said groove (2) and the fastener (4), a light-emitting device (9) was arranged corresponding to a LED strip.

Additionally, the perforation (11) of the first plate (1*a*) was larger compared to the perforation of the second plate (1*b*) and the positioning plate (10), and in the contour of said perforation (11) there was a support element (13) corresponding to a rubber ring, through which the support body (12) was inserted, which allowed the support element (13) to exert force on the support body (12) and thus maintain the device for position elements in a single position.

The first plate (1*a*) had a grooved guide (7), wherein the guide (7) was connected to the groove (2). Inside said guide (7) a locking pin (3) with a first end and a second end was arranged, wherein the first end was located in the part of the guide (7) that connected with the groove (2). Inside the grooved guide (7), there was a pressure element (6) connected to the second end of the locking pin (3).

The locking pin (3) had a hole (15) through which a displacement element (8) was connected, which allowed the locking pin (3) to be moved along the grooved guide (7). Additionally, the second plate (1*b*) had an additional perforation above the grooved guide (7), in order to be able to connect the displacement element (8) with the locking pin (3), and to be able to move said locking pin (3).

The device for positioning elements of FIG. 4, a non-circular arc-shaped fastener (4) was arranged which had a notch (5). Said sample had an incorporated shape with the second end of the locking pin (3) in order to block the fastener (4) in the groove (2).

In said EXAMPLE 3, the procedure to arrange the LED strip is the following: if the fastener (4) is located in the grooves (2), the displacement element (8) is inserted into the hole (15) of the locking pin (3), to move the locking pin (3) on the guide (7). Subsequently, the locking pin (3) is removed from the notch (5) of the fastener (4), in order to remove the fastener (4) from the groove (2). Once the fastener (4) is removed, an element is placed in the grooves (2), such as a light-emitting device (9) corresponding to a LED strip. Subsequently, the fastener (4) is arranged in the groove (2), which allows the light-emitting device (9) corresponding to the LED strip to be fastened between the fastener (4) and the groove (2).

It should be understood that the present invention is not limited to the modalities described and illustrated herein, since there are possible variations and modifications that do not deviate from the spirit of the invention, which is only found defined by the following claims, as will be evident to a person versed in the art.

The invention claimed is:

1. Device for positioning elements along a support body, comprising:

a first plate (1*a*) with a groove (2) on its perimeter;

a second plate (1*b*) with a groove (2) on its perimeter, the first plate (1*a*) is in contact with the second plate (1*b*);

wherein the groove (2) of the first plate (1*a*) and the groove (2) of the second plate (1*b*) are coincident;

wherein the elements to position are arranged between the grooves (2) of the first plate (1*a*) and the second plate (1*b*); and wherein the first plate (1*a*) and second plate (1*b*) have fastening means that allow them to be fastened to the support body (12).

2. The device according to claim 1, wherein the fastening means correspond to a perforation (11) to allow the support body (12) to be inserted in a certain position.

3. The device according to claim 2, characterized in that a support element (13) is located in the contour of the perforation (11) of any of the plates (1*a*) and (1*b*), wherein said support element (13) has a perforation (11) through which the support body (12) is inserted.

4. The device according to claim 1, characterized in that a fastener (4) is located in the groove (2) of any of the plates (1*a*) and (1*b*), wherein an enclosure is formed between the groove (2) of any of the plates (1*a*) and (1*b*) and the fastener (4).

5. The device according to claim 4, characterized in that the first plate (1*a*) includes a guide (7), in said guide (7) a locking pin (3) is positioned having a first end and a second end, wherein the first end is adjacent to the groove (2), and wherein said locking pin (3) moves along said guide (7).

6. The device according to claim 5, characterized in that the locking pin (3) is connected to a displacement element (8), wherein the displacement element (8) is configured to displace the locking pin (3) along the guide (7).

7. The device according to claim 6, characterized in that the fastener (4) has a notch (5), wherein the first end of the locking pin (3) fits in the notch (5) of the fastener (4), which prevents the movement of the fastener (4) in the groove (2).

8. The device according to claim 5, characterized in that the guide (7) is a grooved guide on any of the plates (1*a*) and (1*b*).

9. The device according to claim 8, characterized in that the second end of the locking pin (3) is connected to a pressure element (6), in such a way that it continuously exerts a force on the locking pin (3) along the guide (7).

10. The device according to claim 9, characterized in that the pressure element (6) is selected from the group consisting of: springs, elastomeric materials, and a combination thereof.

11. The device according to claim 5, characterized in that a positioning plate (10) is arranged on the surface of any of the plates (1*a*), (1*b*).

* * * * *